US008408419B2

(12) United States Patent
Rippl et al.

(10) Patent No.: US 8,408,419 B2
(45) Date of Patent: Apr. 2, 2013

(54) SLANTED SHEET DISPENSER

(75) Inventors: Carl G. Rippl, Appleton, WI (US); Sarah L. Christoffel, Appleton, WI (US); George I. Nukuto, Neenah, WI (US); Maggie VanderHeiden Berger, Appleton, WI (US); Jonathan K. Arendt, New London, WI (US); Duane L. McDonald, Neenah, WI (US); James D. McManus, Hortonville, WI (US); Marci E. Sojka, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 314 days.

(21) Appl. No.: 12/215,443

(22) Filed: Jun. 26, 2008

(65) Prior Publication Data

US 2009/0236358 A1 Sep. 24, 2009

Related U.S. Application Data

(60) Provisional application No. 61/070,242, filed on Mar. 19, 2008.

(51) Int. Cl.

| | |
|---|---|
| ***G07F 11/16*** | (2006.01) |
| ***G07F 11/00*** | (2006.01) |
| ***A47F 1/04*** | (2006.01) |
| ***B65G 47/14*** | (2006.01) |
| ***B65G 59/00*** | (2006.01) |

(52) U.S. Cl. ..... 221/305; 221/45; 221/1; 221/34; 221/806; 221/283; 221/63; 248/315; 248/97

(58) Field of Classification Search ..... 221/305, 221/282, 97, 45, 1, 34, 806, 283, 63; 248/315
See application file for complete search history.

(56) References Cited

U.S. PATENT DOCUMENTS

| | | | |
|---|---|---|---|
| 846,683 | A | 3/1907 | Moore et al. |
| 1,119,213 | A | 12/1914 | Abt |
| 1,217,682 | A | 2/1917 | Baldwin |
| 1,525,040 | A | 2/1925 | Painter |
| 1,577,094 | A | 3/1926 | Arms |
| 1,683,641 | A | 9/1928 | Whitney |
| 1,889,985 | A | 12/1932 | Hays |
| 1,897,143 | A | 2/1933 | Powell |
| 2,107,946 | A | 2/1938 | Inman |
| 2,216,323 | A | 10/1940 | Ringler |

(Continued)

FOREIGN PATENT DOCUMENTS

| | | | |
|---|---|---|---|
| EP | 0 587 132 | A1 | 3/1994 |
| EP | 0901769 | A1 | 3/1999 |

(Continued)

OTHER PUBLICATIONS

"CleanEze™ Brand Towels," Internet web page "http://www.cleanezetowels.com/", viewed and printed Jun. 2, 2008, 1 page.

*Primary Examiner* — Gene O. Crawford
*Assistant Examiner* — Rakesh Kumar
(74) *Attorney, Agent, or Firm* — Michael J. Sullivan

(57) ABSTRACT

A sheet dispenser is defined by at least six panels having outwardly facing surfaces, wherein at least one of the panels is oriented at an oblique angle with respect to the other panels. Sheets may be dispensed from an opening located on the oblique surface. The sheet dispenser may sit on a surface such as a countertop for dispensing, or may be placed between a wall and other structure attached to the wall such as a towel bar. Furthermore, the sheet dispenser may be hung from a structure using a strap attached to the towel dispenser.

10 Claims, 13 Drawing Sheets

U.S. PATENT DOCUMENTS 2,287,581 A 6/1942 Walker
2,290,950 A 7/1942 Duncan
2,334,997 A 11/1943 Doll
2,349,589 A 5/1944 Harrington
2,633,986 A 4/1953 Vogt
2,701,089 A 2/1955 Fischer
2,807,403 A 9/1957 Joseph
2,935,192 A 5/1960 De Million-Czarnecki
2,990,950 A 7/1961 Alexander
3,002,651 A 10/1961 Gauld
3,006,527 A 10/1961 Lofquist, Jr.
3,185,378 A 5/1965 Rosenburg, Jr.
3,239,097 A 3/1966 Bates et al.
3,295,740 A 1/1967 Hall
3,339,721 A 9/1967 Goldstein
3,347,363 A 10/1967 Dykes et al.
3,395,830 A 8/1968 Buttery
3,450,308 A 6/1969 Schoenefeld
3,568,883 A 3/1971 Reynolds
3,624,791 A 11/1971 Taub
D257,830 S 1/1981 Card
D259,024 S 4/1981 Roccaforte et al.
D277,169 S 1/1985 Ito et al.
D309,434 S 7/1990 Goldman
4,969,575 A 11/1990 Kobayashi
D321,134 S 10/1991 Toinet
D321,647 S 11/1991 Oldorf
5,118,033 A 6/1992 Kula
5,125,565 A 6/1992 Rogers
D332,214 S 1/1993 Mulder et al.
D333,781 S 3/1993 Kobel
5,215,757 A 6/1993 El Nokaly
5,259,550 A 11/1993 Kuchenbecker
5,516,000 A 5/1996 Freiburger et al.
D376,501 S 12/1996 Spaseska
5,599,555 A 2/1997 El Nokaly
D378,330 S 3/1997 Spaseska
D411,104 S 6/1999 Simile-Gravina et al.
5,980,931 A 11/1999 Fowler et al.
6,024,323 A 2/2000 Palermo, Jr.
6,121,165 A 9/2000 Mackey et al.
D442,083 S 5/2001 Hoffman et al.
D446,451 S 8/2001 Roemer et al.
6,415,949 B1 7/2002 Tramontina
6,423,180 B1 7/2002 Behnke et al.
D463,976 S 10/2002 Sipinen et al.
6,561,378 B1 5/2003 Roessler et al.
6,565,707 B2 5/2003 Behnke et al.
6,575,329 B2 6/2003 Clark
6,602,575 B2 * 8/2003 Lefevre Du Grosriez et al. ..... 428/124
D484,047 S 12/2003 Hirschey
D492,594 S 7/2004 Nash
D494,859 S 8/2004 Keberlein
6,866,185 B2 3/2005 Harrelson
6,960,349 B2 * 11/2005 Shantz et al. ..... 424/402
6,997,342 B2 * 2/2006 Mitchell et al. ..... 221/45
6,997,345 B2 2/2006 Mitchell et al.
D526,897 S 8/2006 Keberlein
D528,435 S 9/2006 Keberlein
7,140,513 B2 11/2006 Welchel et al.
7,207,461 B2 4/2007 Mitchell et al.
7,211,311 B2 * 5/2007 McDonald ..... 428/126
D546,675 S 7/2007 Keberlein
7,297,231 B2 11/2007 Goulet et al.
7,571,832 B2 * 8/2009 Mark et al. ..... 221/48
2002/0092789 A1 7/2002 Sauer et al.
2003/0102243 A1 6/2003 Sab
2004/0124207 A1 7/2004 Tramontina et al.
2005/0000976 A1 1/2005 Keberlein
2006/0049074 A1 3/2006 Long et al.
2006/0122574 A1 * 6/2006 Gooding ..... 604/385.201
2006/0214048 A1 9/2006 Sucher
2006/0237474 A1 * 10/2006 Long ..... 221/33
2006/0273107 A1 * 12/2006 Keberlein ..... 221/305
2006/0289557 A1 * 12/2006 Mitchell et al. ..... 221/97
2007/0138035 A1 * 6/2007 Fluegel et al. ..... 206/229
2007/0262086 A1 * 11/2007 Cook et al. ..... 221/305
2012/0107544 A1 * 5/2012 Formon et al. ..... 428/43

FOREIGN PATENT DOCUMENTS

JP 06-073502 B2 9/1994
JP 2001-504731 A 4/2001
KR 10-2005-0080130 A 8/2005

* cited by examiner

SLANTED SHEET DISPENSER

This application claims the benefit under 35 U.S.C. 119(e) to provisional application Ser. No. 61/070,242, entitled Slanted Sheet Dispenser, and filed in the U.S. Patent and Trademark Office on Mar. 19, 2008. The entirety of provisional application Ser. No. 61/070,242 is hereby incorporated by reference.

The present invention is directed to a sheet dispenser, in particular, a paper towel dispenser that can dispense sheets when the dispenser is positioned on a horizontal surface or towel bar.

Singly used paper towels are more sanitary than cloth towels that are used multiple times. Bacteria may grow on damp, used towels. However, paper towel dispensers are not typically used where they are most needed, in the bathroom. Existing paper towels are typically seen in commercial facilities, but they require permanent attachment to the wall and may not be aesthetically pleasing for a residential setting. Paper towel dispensers available for residential use are designed for roll-style paper towels, not interfolded paper towels. There remains a need for a sheet dispenser that is versatile enough to be used on a counter top or in conjunction with a towel bar. Further, there is a need for a sheet dispenser that is differentiated from other sheet dispensers, e.g. facial tissue dispensers.

SUMMARY OF THE PRESENT INVENTION

In a first embodiment of the present invention there is a sheet dispenser which includes a carton having an interior volume defined by at least six outwardly-facing surfaces. The six outwardly-facing surfaces are defined by three pairs of panels: a face panel substantially parallel to and spaced apart from a contact panel, a first side-panel substantially parallel to and spaced apart from a second side-panel, and a dispensing panel substantially parallel to and spaced apart from an obscure panel. The dispensing panel has a surface area with a removable surfboard member therein defined by an opening edge. The surfboard member being directly adjacent a bearing region, wherein the bearing region is 38 to 51 percent of the dispensing panel surface area and does not coincide with the removable surfboard member. Each of the first and second side-panels together define a trapezoid.

In a second embodiment of the present invention there is a sheet dispenser which includes a carton having an interior volume defined by at least six (6) outwardly-facing surfaces: a face panel substantially parallel to and spaced apart from a contact panel, a first side-panel substantially parallel to and spaced apart from a second side-panel, and a dispensing panel spaced apart from an obscure panel. An acute edge is located between the dispensing panel and contact panel, and an obtuse edge is located between the dispensing panel and face panel. The dispensing panel has a first longitudinal axis and an opening for dispensing a sheet. The opening has an opening longitudinal axis as determined from the shape created by the opening edge, wherein the opening longitudinal axis is located between the first longitudinal axis and the acute edge.

In yet another aspect of the present invention is a method of dispensing sheets having the steps of: providing a sheet dispenser as described in the first embodiment; identifying a wall having a towel bar mounted thereon at a distance from a floor; facing the contact panel toward the wall and sliding the sheet dispenser between the towel bar and the wall such that the dispensing panel is oriented toward the floor.

In a further aspect of the present invention is a method of dispensing sheets comprising the steps of: providing a sheet dispenser of the second embodiment of the present invention; identifying a wall having a towel bar mounted thereon at a distance from a floor; facing the contact panel toward the wall and sliding the sheet dispenser between the towel bar and the wall such that the dispensing panel is oriented toward the floor.

BRIEF DESCRIPTION OF THE DRAWINGS

A full an enabling disclosure of the present invention, including the best mode thereof, directed to one of ordinary skill in the art, is set forth more particularly in the remainder of the specification, which makes reference to the appended figures in which.

DETAILED DESCRIPTION

The sheet dispenser 10 of the present invention is a carton 12 from which a towel substrate may be dispensed, the carton having a pair of rhomboid or trapezoidal shaped panels. Carton 12 has an opening 14 from which sheets 16 may be dispensed. Sheet dispenser 10 may be positioned with respect to a variety of surfaces commonly found in a household, making it versatile with respect to placement in the home. For example, towels may be dispensed from the sheet dispenser 10 when it is either resting on a countertop or wedged between a wall and a towel bar. Furthermore, the shape of the sheet dispenser 10 differentiates it from other sheet-dispensing cartons such as facial tissue dispensers.

Figure 1:
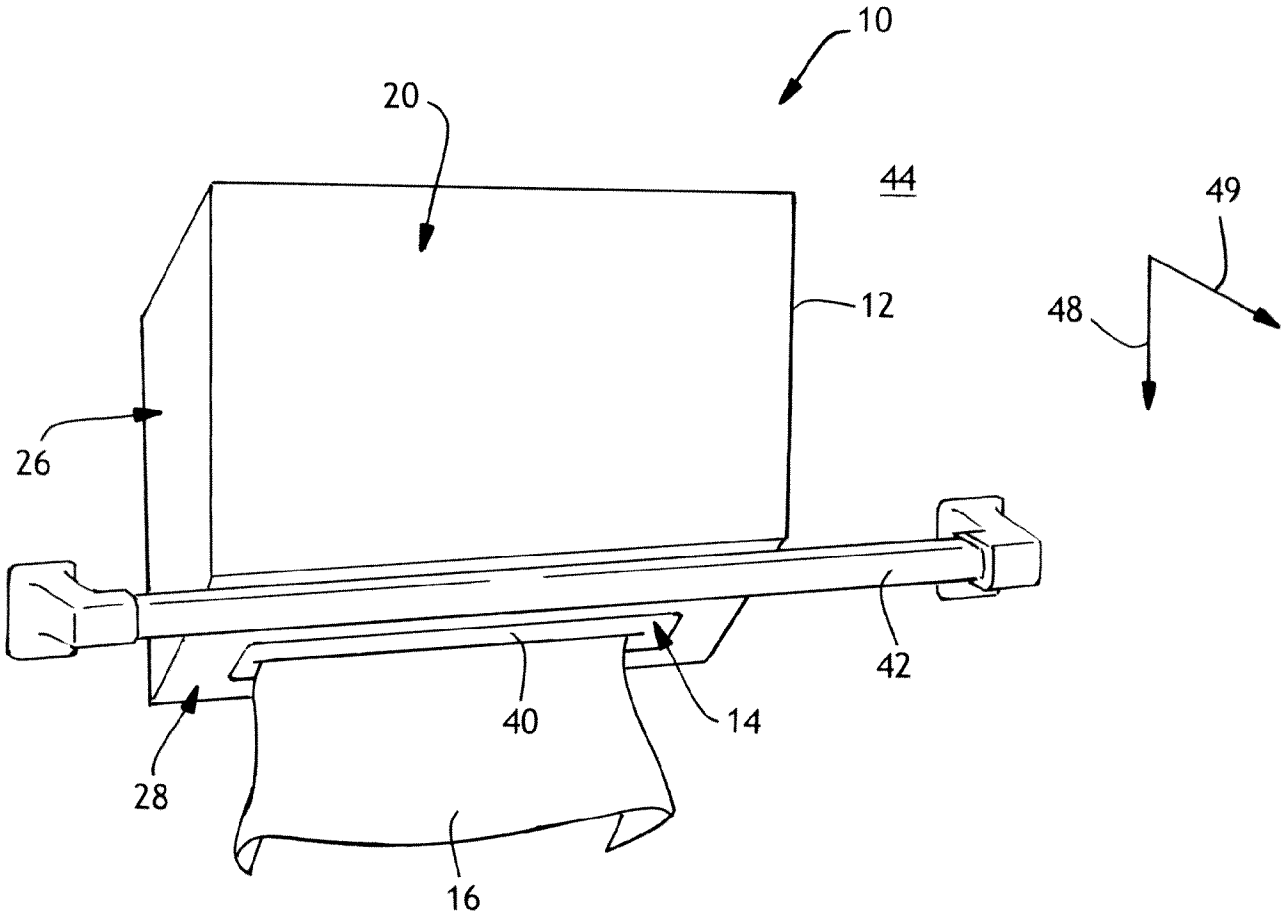
FIG. 1 is a front perspective view of a first embodiment of the sheet dispenser of the present invention, the dispenser positioned for dispensing a sheet between a towel bar and a wall.
Figure 2:
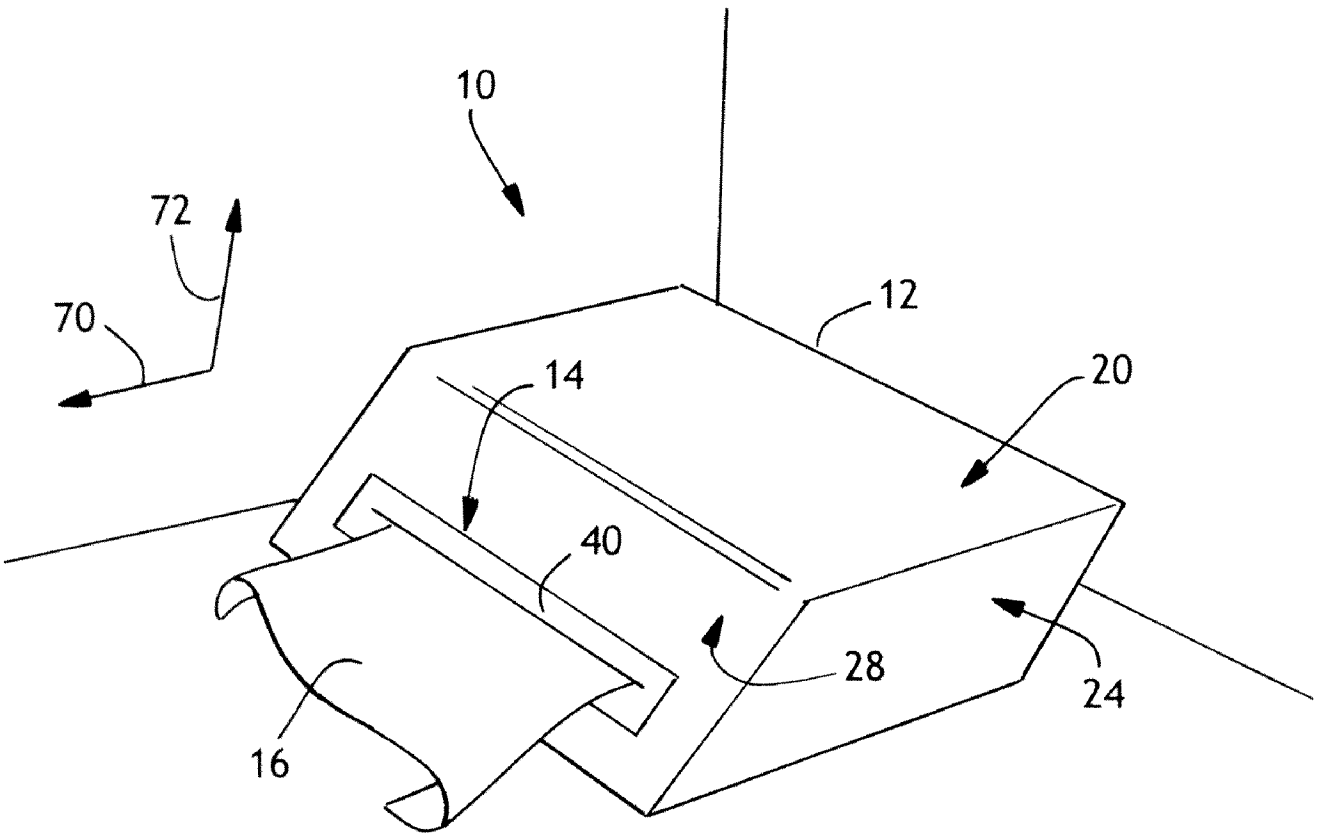
FIG. 2 is a side perspective view of the sheet dispenser of FIG. 1, the dispenser positioned for dispensing a sheet from a horizontal surface such as a countertop.
Figure 3:
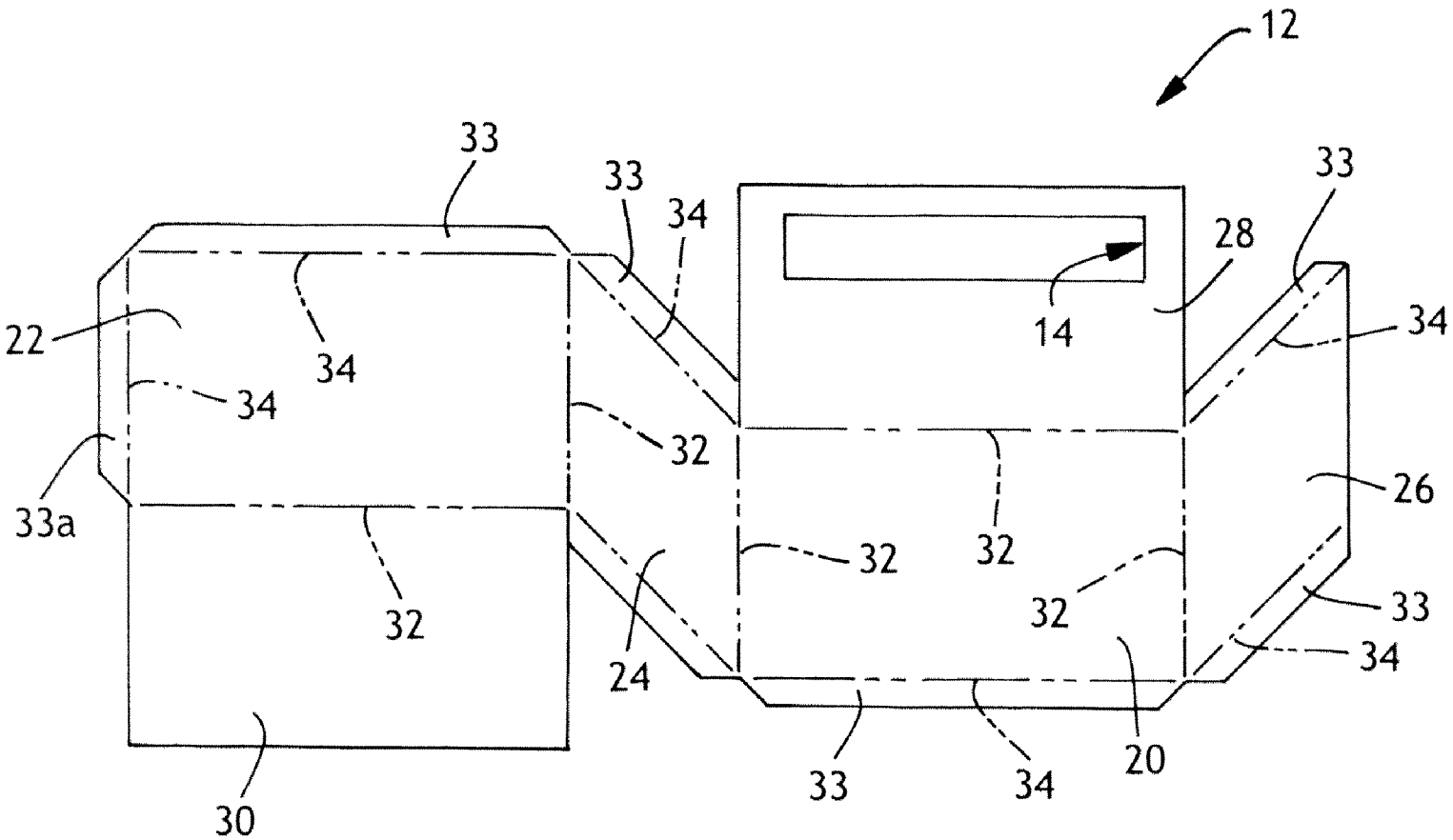
FIG. 3 is a plan view of a carton blank used to form the sheet dispenser of FIGS. 1 and 2.

In one embodiment of the present invention, the sheet dispenser 10 is a quadrilateral carton 12 defined by four surfaces each having a rectangular area, and two surfaces each having a rhomboid area. Referring now to FIGS. 1-3, carton 12 has six outwardly-facing surfaces defined by three pairs of panels. One panel pair is a face panel 20 which is substantially parallel to and spaced apart from a contact panel 22. Another panel pair is a first side-panel 24 substantially parallel to and spaced apart from a second side-panel 26. The last panel pair is a dispensing panel 28 substantially parallel to and spaced apart from an obscure panel 30.

The panels 20-30 may be integrally connected as shown in FIG. 3, and differentiated from one another by fold lines 32. However, it is contemplated that the panels may be distinct and separate parts that are connected together to form a three-dimensional carton such as sheet dispenser 10. For example, referring to FIG. 3, it can be seen that panel 22 is separated from panel 30 by a fold-line 32.

A margin 33 may extend from a panel to provide a structure to which other panels may be attached such as by glue, or the like. Each margin 33 may be separated from its neighboring panel by a fold line 34, though it is contemplated that margins 33 may be non-integral parts, such as a tape or the like. For example, referring to FIG. 3, it can be seen that two margins 33 extend from panel 22 at adjacent sides, separated by a fold-line 34.

Without regard to margins 33, each of the panels in a panel pair are desirably identical in size and shape. In the embodiment shown in FIG. 3, panels 20 and 22 are identical to not only each other, but the panels 28 and 30. Rhomboid shaped panels 24-26 are also identical in size and shape.

The margins may be folded and attached to the interior surfaces of panels once the container is folded to form a volume for containing sheets 16. The margins may be attached to the interior surfaces with an adhesive or the like.

Desirably, the panels are cut from a sheet material such that when combined, they form a blank 13. Depending on the embodiment of the present invention, the sheet dispenser 10 may be rigid (like a sheet of 4 mm thick acrylic), or semi-rigid (like an 80 lb basis weight paper board). Thus, the sheet material may be that typically used in paperboard box construction, such as a facial tissue box (e.g. a KLEENEX® Facial Tissue box) or a cereal box. It is further contemplated that the sheet material may be formed from a semi-rigid plastic sheet, or the like. The sheet material may have the characteristics of being scoreable, foldable, and cuttable using a die or by other sheet cutting techniques.

In the embodiment shown in FIG. 3, the blank 13 may be folded about the various fold lines to form a carton with an interior volume for containing a stack of sheets, such as towel substrates. The sheets may have a V-fold ("inter-fold") or a Z-fold ("multi-fold") as is known in the art of tissue folding. There are other possible panel arrangements that may be used other than that shown in FIG. 3. For example, panel 26 could be attached to panel 22 instead of panel 20. Other variations are possible.

The sheet dispenser 10 includes a stack of folded sheet material 16 disposed within the interior volume of the carton to form a sheet dispenser assembly. One non-limiting example of a sheet material 16 is paper or non-woven toweling.

Figure 9:
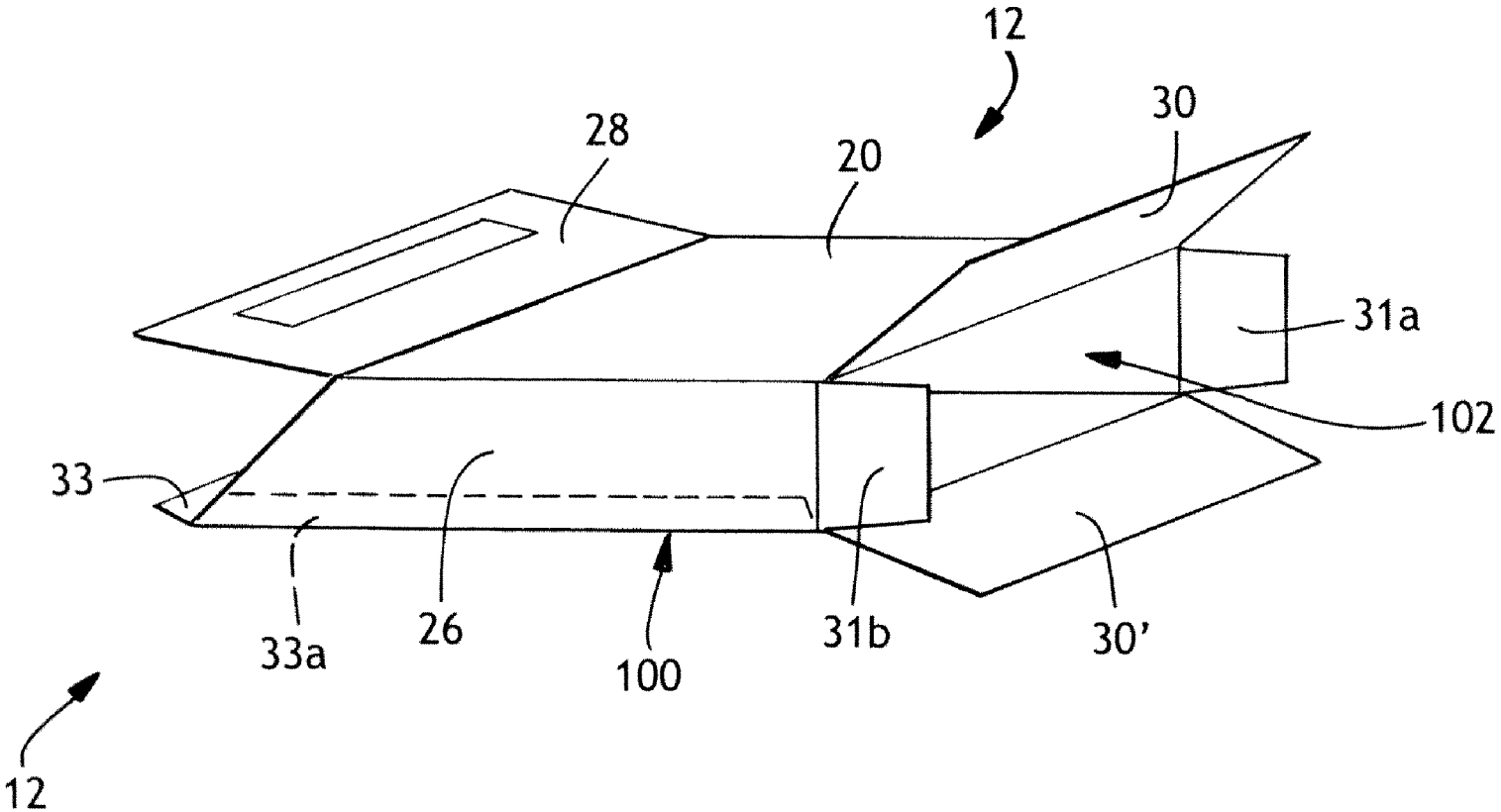
FIG. 9 is a side perspective view of a partially assembled carton as seen in FIG. 7.

The embodiments shown in FIG. 9 is one example of a sleeve-style carton. During the assembly process, a sheet stack 90 is loaded into the carton sleeve cavity 102 from an open end adjacent to panel 30 or panel 28.

Figure 10:
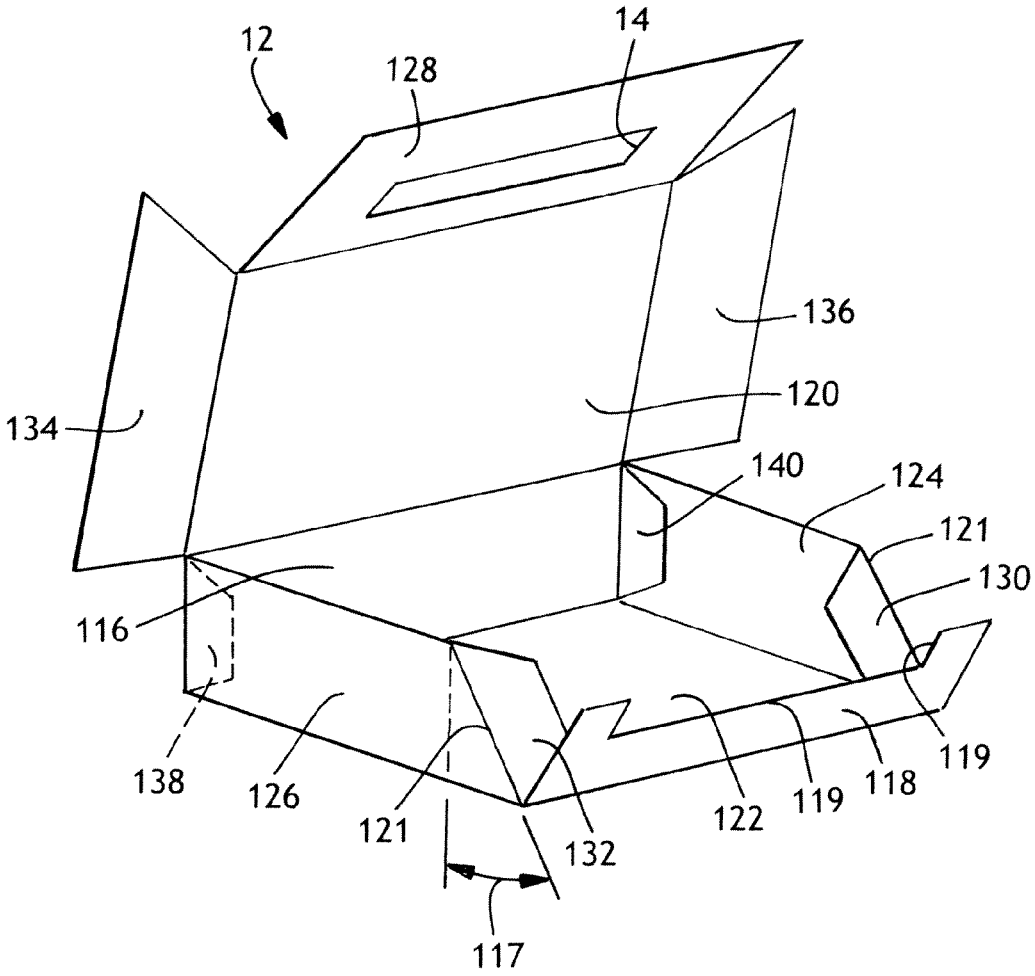
FIG. 10 is a perspective view of a partially assembled carton used in a third embodiment of the present invention.

Referring now to FIG. 10, shown is a tray-style carton 12 in a partially assembled state. Tray-style containers require one less manufacturing step than the sleeve-style carton of FIG. 3 because a sleeve does not have to be created before sheets are loaded into the carton 12. The carton 12, once completely assembled, is defined by four surfaces each having a rectangular area, and two surfaces each having a trapezoidal area. In this embodiment, carton 12 has six outwardly-facing surfaces defined by three pairs of panels. One panel pair is a face panel 120 which is substantially parallel to and spaced apart from a contact panel 122. Another panel pair is a first-side panel 124 substantially parallel to and spaced apart from a second-side panel 126. The last panel pair is a dispensing panel 128 that is spaced apart from an obscure panel 116. As in the previous embodiments, the dispensing panel 128 is angled with respect to the obscure panel 116 in the same ranges of angles. Most desirably, the angle 117 is about 45 degrees.

Face panel 120 is a rectangular panel that has the dispensing panel disposed on one side and the obscure panel 116 disposed on an opposite side. From the remaining opposing sides, face panel 120 has a first trapezoidal panel 134 and a second trapezoidal panel 136 extending therefrom. Desirably, panel 134 may be sized to at least partially cover the side panel 126, and panel 136 is sized to at least partially cover panel 124. Panels 134, 136 may be reduced in size and even reshaped so that in the event the container is slightly skewed during the manufacturing process, the panels 134, 136 would not extend beyond the edges defining panels 126 and 124, respectively.

The three remaining sides of obscure panel 116 have panels disposed thereon. From a side opposite face panel 120 there extends the contact panel 122. From the remaining opposing sides extend tabs 138 and 136, which are used to fix obscure panel 116 at a right angle with respect to contact panel 122 and face panel 120. From a side opposite obscure panel 116 is a half-panel 118. Half-panel 118 is a rectangular panel that may have a squared-notch located and defined by the distal edge 119. The notch serves to accommodate the opening defined by edge 14. Half-panel 118 is used to abut the dispensing panel 128 with the contact panel 122.

Extending from the slanted edges 121 of the side panels 124 and 126 are a pair of tabs 130 and 132, respectively. Tabs 130 and 132 are used to abut the dispensing panel 128 to the side panels 124 and 126.

Figure 11:
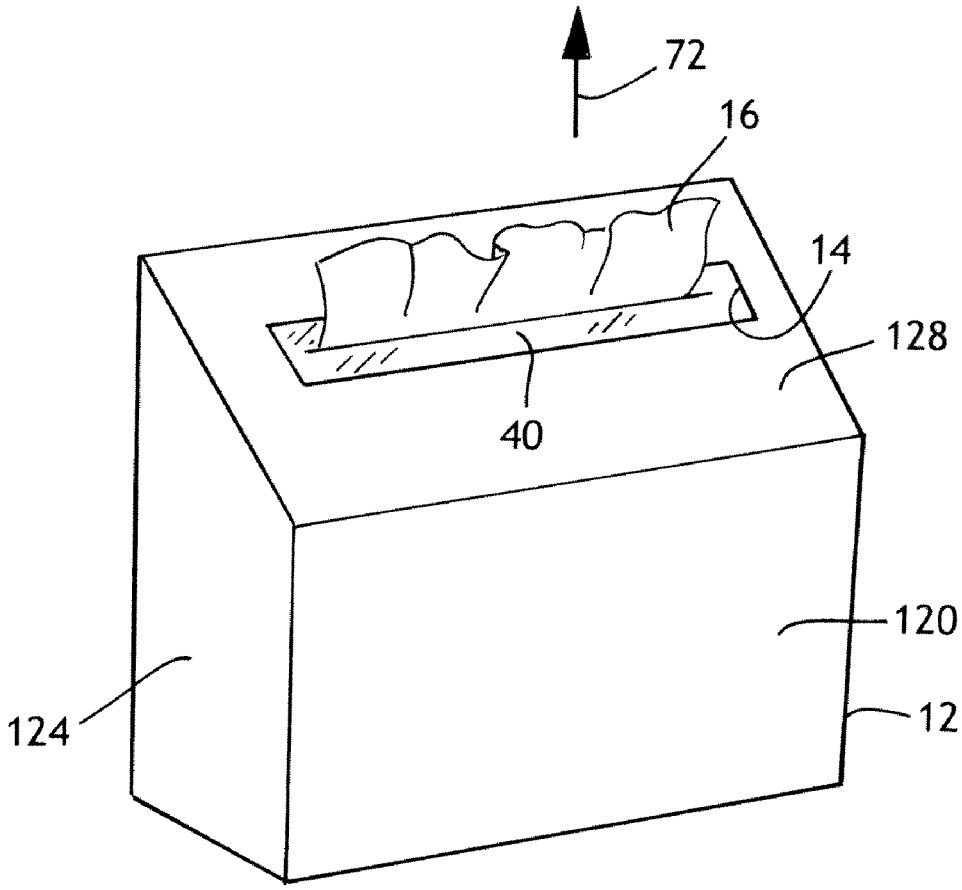
FIG. 11 is a perspective view of a partially assembled carton as seen in FIG. 10.

A stack of sheets is loaded into the partially assembled container 12 by disposing the stack against the contact panel 122, side panels 124 and 126, and obscure panel 116. The face panel 120 is then brought into contact with the stack and the remaining panels attached together to form an assembled carton 12, as seen in FIG. 11.

Figure 12:
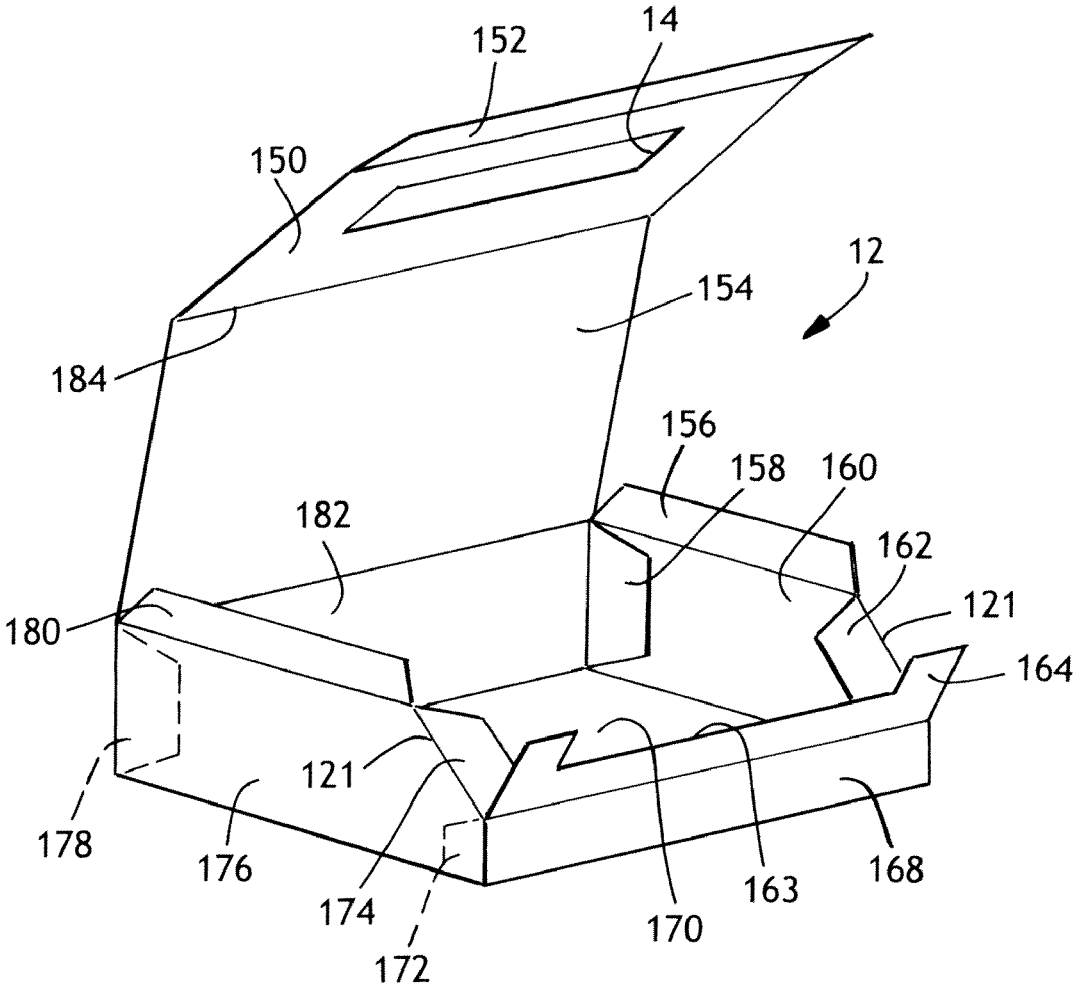
FIG. 12 is a front perspective view of a fourth embodiment of the present invention.

Referring now to FIG. 12, shown is another tray-style container 12 in a partially assembled state. The carton 12, once completely assembled, is defined by four surfaces each having a rectangular area, and two surfaces each having a five-sided polygonal area. In this embodiment, carton 12 has six outwardly-facing surfaces defined by three pairs of panels. One panel pair is a face panel 154 which is substantially parallel to and spaced apart from a contact panel 170. Another panel pair is a first-side panel 160 substantially parallel to and spaced apart from a second-side panel 176. The last panel pair is a short dispensing panel 168 that is parallel and spaced apart from an obscure panel 182. Between one edge of the short dispensing panel 168 and the face panel 154 is a dispensing panel 150. As in the previous embodiments, the dispensing panel 150 is angled with respect to the obscure panel 182 in the same ranges of angles. Most desirably, the angle 117 is about 45 degrees.

Dispensing panel 150 is a rectangular panel that has a short panel 152 extending therefrom, and from an opposite side, the face panel 154 extending therefrom. Short panel 152 may be sized to cover the short dispensing panel 168.

From the face panel 154, there extends the obscure panel 182 from an edge opposite the dispensing panel 150. From the remaining two sides there extends tabs 158 and 178, which are used to fix obscure panel 182 at a right angle with respect to contact panel 170 and face panel 154.

From the three remaining sides of obscure panel 182 extend the side panels 176 and 160, and the short dispensing panel 168. The short dispensing panel 168 extends from the side opposite to the obscure panel 182.

The three remaining sides of short dispensing panel 168 have panels disposed thereon. From a side opposite contact panel 170 there extends the half-panel 164. Half-panel 164 is a rectangular panel that may have a squared-notch located and defined by the distal edge 163. The notch serves to accommodate the opening defined by edge 14. Half-panel 164 is used to abut the dispensing panel 150 with the short dispensing panel 168. Tabs 172 (only one shown) extend from the remaining sides of the short dispensing panel 168, and are used to abut the side panels 160 and 176 to the short dispensing panel 168. Alternatively, tabs 172 could extend from the sides 160 and 176.

Extending from the slanted edges 121 of the side panels 160 and 176 are a pair of tabs 162 and 174, respectively. Tabs 162 and 174 are used to abut the dispensing panel 150 to the side panels 160 and 176.

Figure 13:
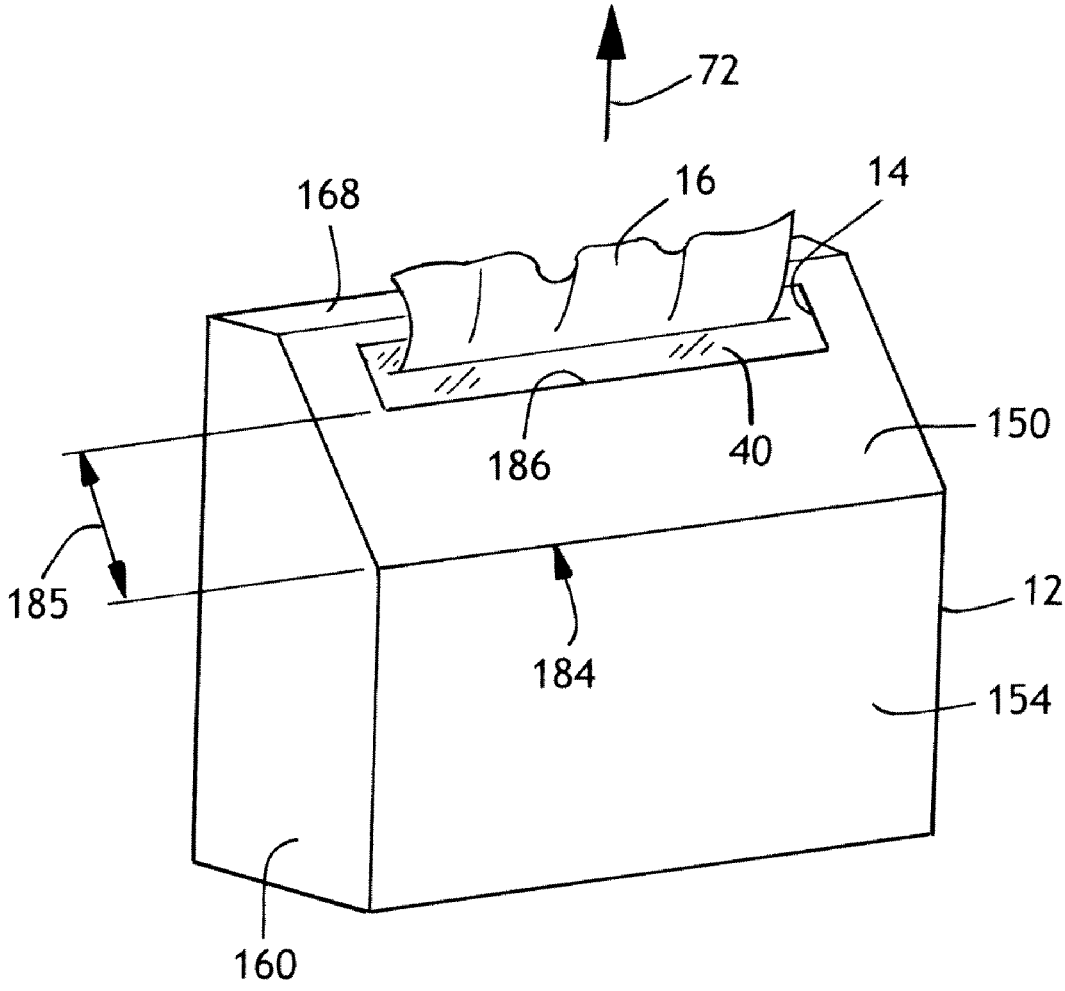
FIG. 13 is a perspective view of a partially assembled carton as seen in FIG. 11.

A stack of sheets is loaded into the partially assembled container 12 by disposing the stack against the contact panel 170, side panels 160 and 176, and obscure panel 182. The face panel 154 is then brought into contact with the stack and the remaining panels attached together to form an assembled carton 12 as seen in FIG. 13.

Regardless of embodiment, the opening as defined by edge 14 of the previously described dispensing panels 28, 128 and 150 may be a rectangular shape. However, opening edge 14 may define other shapes such as oval, "smile," dog-bone, or other such elongated shapes. Desirably, a sheet of flexible, smooth material, referred to as a baffle 40, is used to make the opening smaller to provide some tension on the sheet material 16 as they are pulled from the dispenser 10. The baffle 40 prevents more than one sheet being pulled from the opening at one time. Further, baffle 40 helps to protect the sheet material 16 from the surrounding environment where there is a potential for water splashing or the like. Desirably, the baffle 40 is made from a sheet of clear polyethylene or the like, and is attached around its perimeter to the inwardly-facing surface (not shown) of panel 28. It is, however, contemplated that the baffle could be made from an opaque material, a paper or non-woven material, or have an aesthetic and/or informative indicia thereon. For example, to further differentiate the dispenser 10 from a facial tissue dispenser, the baffle may have a logo such as KLEENEX® HAND TOWELS printed thereon.

Figure 6:
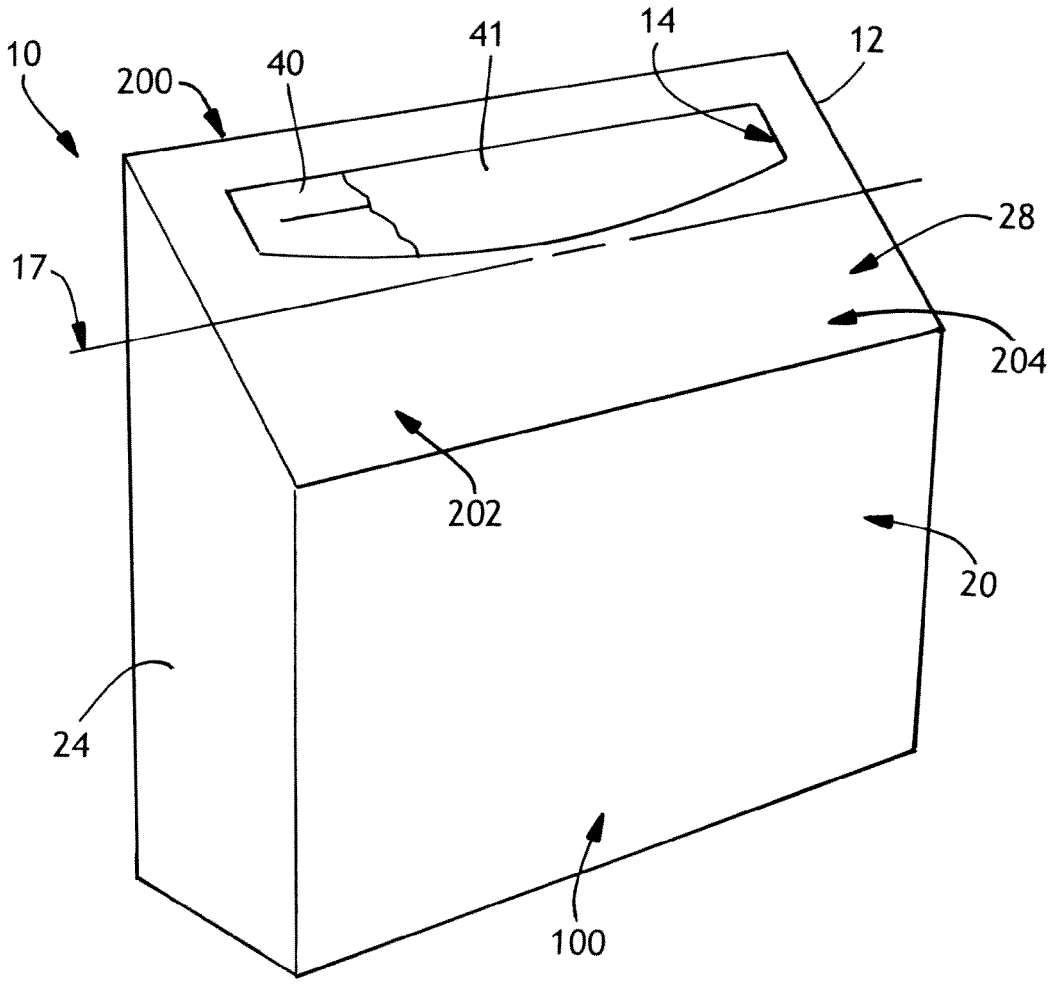
FIG. 6 is a front perspective view of a second embodiment of a container of the present invention.

The location of the opening defined by edge 14 can sometimes be critical for proper dispensing of sheet material 16. When the carton 12 (as seen in FIGS. 2, 6, 11, and 13) is placed between a structure such as a towel bar 42 and a wall 44 (as seen in FIG. 1), it is necessary to prevent the towel bar from obstructing the opening 14. Therefore, the opening defined by edge 14 is located at a particular region of the dispensing panel, and may or may not be covered by a surfboard 41 (e.g., FIG. 6). Referring in particular to FIG. 6, the dispensing panel 28 has a longitudinal axis 17 bisecting the dispensing panel surface area. It is noted that for the purpose of this discussion the dispensing panel surface area is the entire surface area of the outwardly-facing surface of the dispensing panel 28, regardless of whether or not there is an opening or surfboard 41. Desirably, the edge 14 is located on the dispensing panel entirely between the longitudinal axis 17 and the edge between the dispensing panel and the contact panel, referred to as acute edge 200. Acute edge 200 is opposite the edge located between the dispensing panel and face panel, and is referred to as the obtuse edge 202.

The opening edge 14 defines a shape having its own longitudinal axis. In some embodiments of the present invention, this opening longitudinal axis is located between the dispensing panel longitudinal axis 17 and the acute edge 200 so that the opening is offset toward the acute edge.

In all embodiments of the present invention, there is a bearing region area 204 (defined as the dispensing panel 28 area located between the obtuse edge 202 and the longitudinal axis 17) on which a structure such as a towel bar can apply force to dispenser 10. In one embodiment of the present invention, the bearing region area 204 is about 38 to about 60 percent of the dispensing panel 28 area. In yet another embodiment, the bearing region area is about 39 to about 45 percent of the dispensing panel area. It is possible that a portion of the opening edge 14 crosses over the longitudinal axis of the dispensing panel 28, yet the opening edge 14 never crosses into the bearing region area 204.

Figure 4:
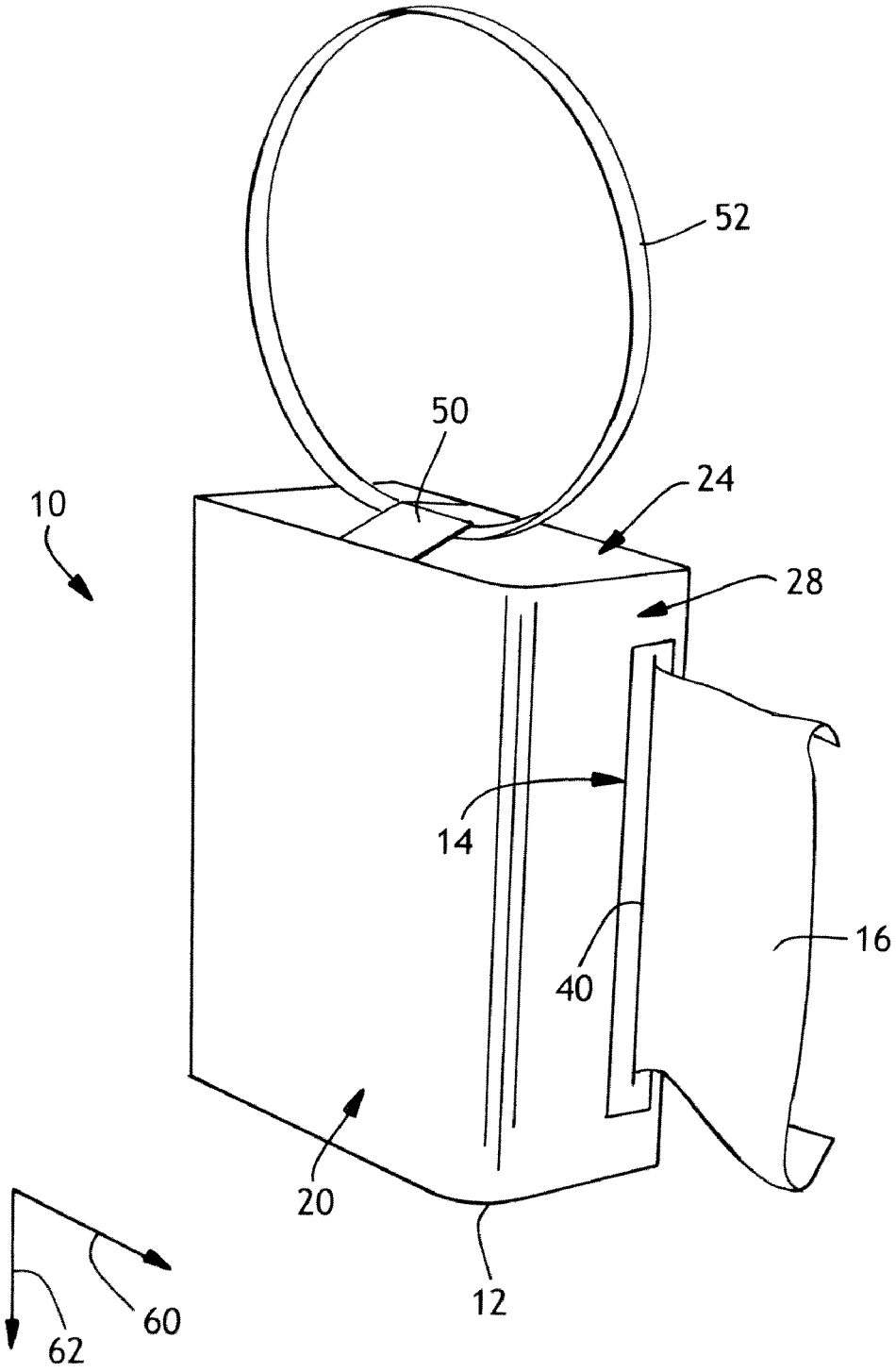
FIG. 4 is a front perspective view of a second embodiment of the sheet dispenser of the present invention, the dispenser positioned for dispensing a sheet from a support attached to a wall, such as a towel ring.
Figure 5:
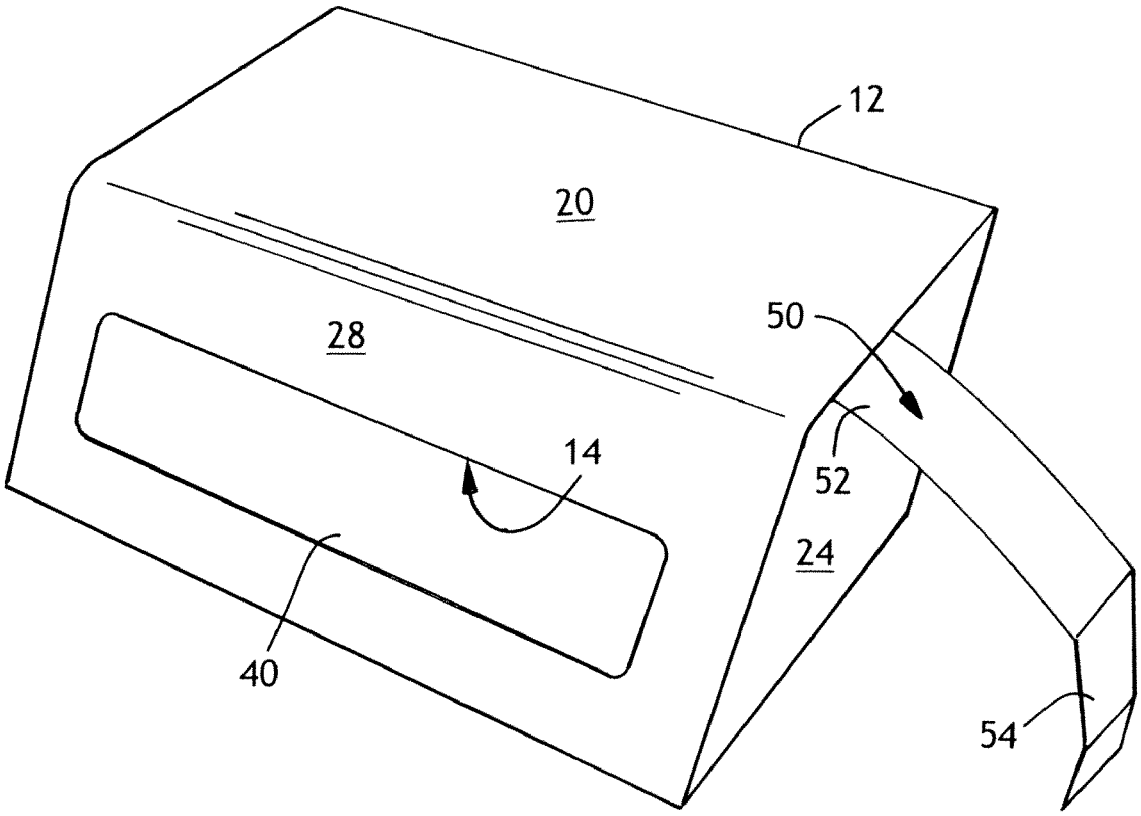
FIG. 5 is a side perspective view of the sheet dispenser of FIG. 4, showing a strap ready to engage a support for hanging.

In yet another embodiment of the present invention as seen in FIG. 4, an additional member is used as a hanging device. In particular, a strip 50 may be used to hang the dispenser 10 from a structure such as a towel ring 52. Referring to FIG. 5, a hanging strip 50 may at one end 52 be integrally connected to a panel (e.g. panel 20), and have an opposite free end 54 that is attachable to the contact panel 30 (not shown). In a further embodiment, the strip 50 may be a completely separate piece, attached to the carton by an adhesive or other attachment means. It is further contemplated that strip 50 may be an adhesive tape and/or may wrap fully about the panels 20, 22, 24 and 26. In operation, the strip 50 is positioned over a support such as a towel ring 52, and sheets 16 are removed by pulling the sheet in a substantially horizontal direction 60 (see FIG. 4). In another embodiment (not shown), the strip 50 is attached to the face panel 20 and the contact panel 22. The dispenser 10 is oriented such that the sheet may be instead be pulled in a downward direction 62 (see FIG. 4).

Referring to FIG. 2, the sheets 16 may be removed by pulling the sheets anywhere from a horizontal direction 70 to an upward direction 72.

In yet another embodiment, the carton 12 may be hung from a support such as a towel bar as shown and described in U.S. Patent Ser. No. 61/003,359, filed on Nov. 16, 2007, incorporated herein to the extent it is consistent with the present invention.

Figure 7:
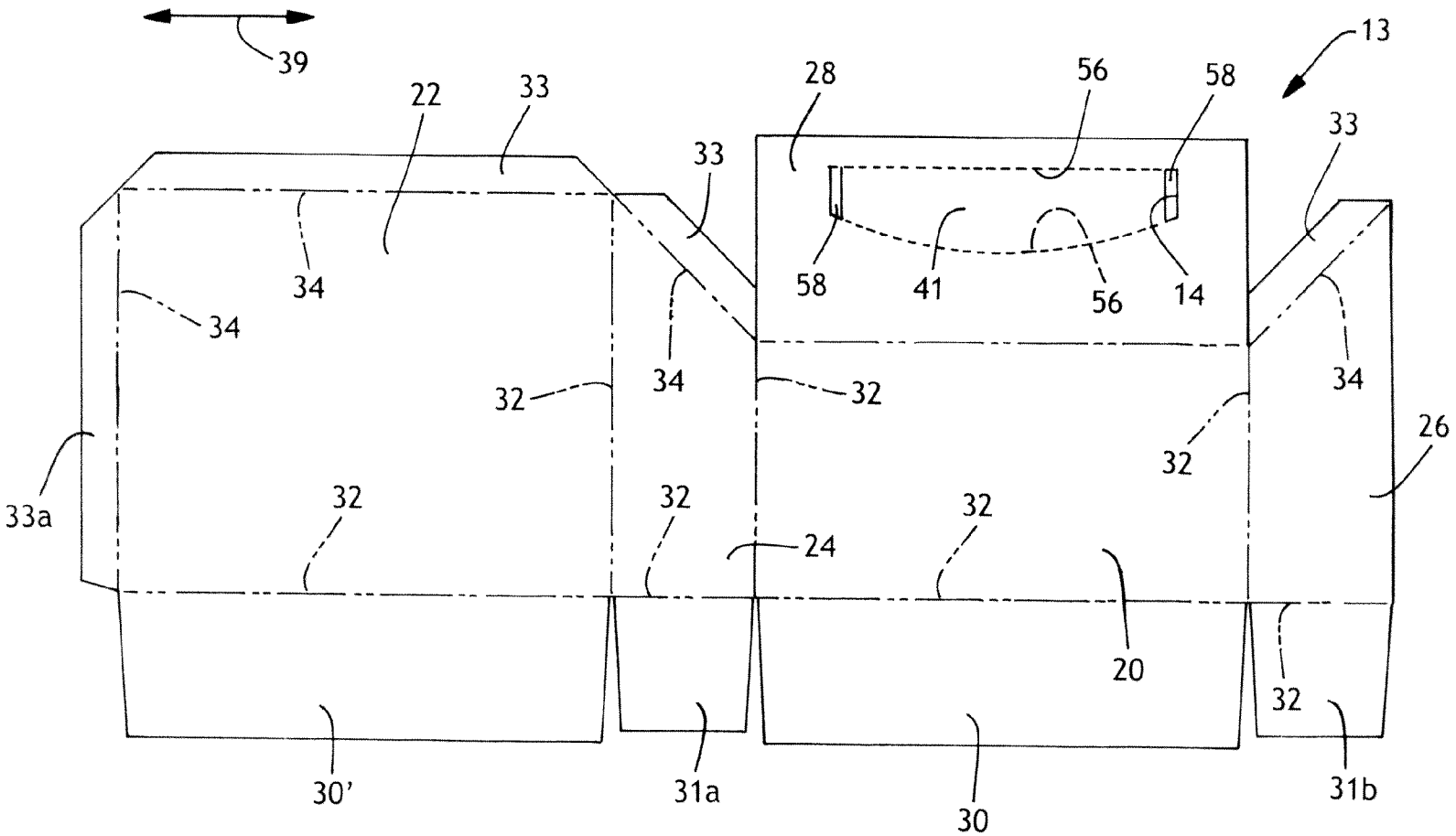
FIG. 7 is a plan view of a carton blank used to form the sheet dispenser of FIGS. 6, 8 and 9.
Figure 8:
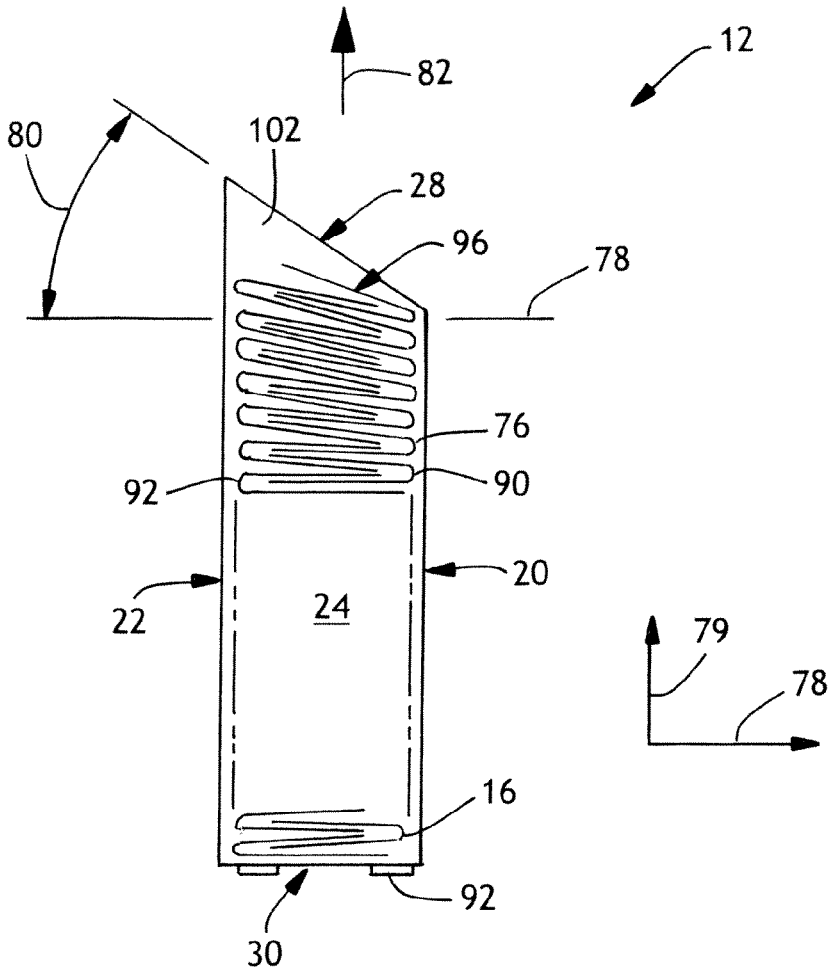
FIG. 8 is a side elevation of the container shown in FIG. 6, the stack of towel substrate and visible through the side panel.

Yet another embodiment of the present invention is depicted in FIGS. 6-8. The primary difference between this embodiment and the embodiment shown in FIGS. 1-5 is that carton 12 has sides that are shaped like a trapezoid instead of a parallelogram. Thus, the dispensing panel 28 is not parallel to the panel 30.

Referring now to FIG. 6, carton 12 is defined by four surfaces each having a rectangular area, and two surfaces having a trapezoidal area. These six outwardly-facing surfaces defined in part by two pairs of panels. One rectangular panel pair is a face panel 20 which is substantially parallel to and spaced apart from a contact panel 22 (not shown in FIG. 6). The trapezoidal panel pair is a first-side panel 24 substantially parallel to and spaced apart from a second-side panel 26. The rectangular dispensing panel 28 is spaced apart from a rectangular obscure panel 30. Obscure panel 30 has a right-angle orientation with respect to panels 20, 22, 24, and 26.

As in the previous embodiment, panels 20-30 may be integrally connected and differentiated from one another by fold lines 32. However, the panels may be distinct and separate parts that are connected together to form a three-dimensional carton such as dispenser 10. Referring now to FIG. 7, a blank 13 is depicted. Previous embodiment, lines 32 separate panels 22, 24, 20, 26, and 28. Margins 33 may extend from one or two sides of panels 22, 24, and 26. Carton 12 may be folded such that either panel 30 or 30' is an outwardly facing surface. Panels 31*a* and 31*b* may not be visible from the exterior surface of carton 12 when carton 12 is fully assembled. It is noted that blank 13 is only one possible configuration that could be used to create carton 12.

The opening defined by edge 14 may not be created until the optional surfboard 41 is removed from the dispensing panel 28. The surfboard 41 can be defined by at least one line of perforations surrounding the opening 14. For example, as seen in FIG. 7, a pair of spaced apart perforation lines 56 and a pair of spaced apart apertures 58 define the shape of surfboard 41. Perforation lines 56 may be straight or curved, or a combination thereof, as shown. Apertures 58 may be replaced by perforation lines 56, but are desirable because they allow a gap for a consumer to grasp the surfboard 41 for removal. Desirably, the machine direction 39 of blank 13 coincides with the longitudinal axis of the surfboard 41 so that it is easier to remove the surfboard without tearing the panel 28.

Referring now to FIG. 8, a side elevation of carton 12 may be seen. From this vantage point, obscure panel 30 is substantially parallel to the X-direction 78, while face panel 20 and contact panel 22 are substantially parallel to the Y-direction 79. Dispensing panel 28 may be oriented at a 20 to 60° angle 80 with respect to X-direction 78. It is further contemplated that panel 28 may be oriented at a 30° to 50° angle 80 with respect to the X-direction 78. Most desirably, dispensing panel 28 is oriented at a 45° angle 80 with respect to X-direction 78. The 45° angle 80 orientation allows cartons 12 to be packed into a shipping package most efficiently as there will be no significant gaps between the cartons 12. Not only is this more efficient, it may protect the packaging from significantly rubbing against one another and potentially damaging the outwardly facing surfaces of carton 12 or any graphics thereon. The sheets 16 may be made from paper, woven, or nonwoven substrates, or composites thereof. Most desirably, a towel substrate in any of the carton 12 embodiments described herein is made from a paper substrate that has a relatively high bulk and wet-strength ratio. One example of such a substrate is a paper towel that has a dry, specific modulus less than 0.0040 kilograms, a bulk greater than 10 cubic centimeters per gram, and a wet strength ratio greater than 0.40. Further details regarding the most desired sheet 16 substrates and the various test methods used to determine the aforementioned physical properties may be found in U.S. Pat. Nos. 6,423,180 6,565,707; and U.S. Pat. No. 7,297,231; each incorporated herein in their entirety to the extent they are consistent with the present invention.

As mentioned previously, the stack 76 of individual sheets 16 may be comprised from multi-folded or inter-folded sheets. When sheets 16 are stacked in a multi-folded or inter-folded configuration, there is a portion between each consecutive sheet that overlaps, namely the overlap portion 75 (see FIG. 8A).

Desirably, the stack 76 has a single towel closest to the opening defined by edge 14. Most desirably, the leading edge of this single towel is visible from the opening to prevent a user from having to reach inside the container to find the leading edge.

Figure 8A:
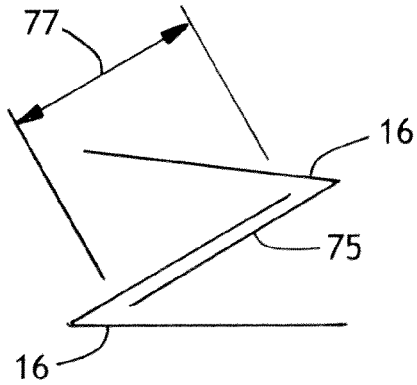
FIG. 8A is a side elevation of a pair of sheets demonstrating one embodiment of a fold and overlap configuration.

When stack 76 is viewed from the side as in FIGS. 8 and 8A, the length 77 of overlap 75 may be observed. Length 77 can become important when the substrate from which sheet 16 is made is subject to blocking. "Blocking" occurs when the towel substrate sticks to itself either chemically or mechanically. Blocking usually happens as the stack of substrate is shipped or moved repeatedly. Blocking can be problematic as it may cause more than one towel to be dispensed from container 12 at one time. However, blocking can be an advantage when the dispensing panel is facing upward, so the towels do not fall down into the cavity 102, away from the opening. This allows dispensing of the last few towels without having to shake carton 12 or turn it upside down. By controlling length 77, the tendency for more than one towel to be dispensed at one time is greatly reduced, if not completely diminished.

For the desired paper towel substrate described above, multi-folded towels have an overlap length 77 of about 2.75 inches to about 3.25 inches, and the inter-folded towels have an overlap length 77 of about 4.75 inches to 5.25 inches. In another embodiment of the present invention, multi-folded towels may have an overlap length 77 of about 3 inches, and the inter-folded towels may have an overlap length 77 of about 5 inches.

Regardless of embodiment, it may be desirable to maximize the number of towels contained within the interior volume of carton 12. With respect to the embodiment shown in FIGS. 6-8, there is an opportunity to utilize some of the volume located underneath dispensing panel 28. While sheets 16 may not dispense easily if the entire volume located under the dispensing panel 28 is occupied by a stack 76, it is reasonable to occupy a portion of that space. For example, as seen in FIG. 8, a front side 90 of stack 76 is lower in height than the opposite rear side 92 of stack 76. Specifically, front side 90 may be shorter than second side 92 by about 10 mm to about 30 mm. It is further contemplated that front side 90 may be shorter than second side 92 by about 10 mm to about 15 mm. It is noted that the height of front side 90 and second side 92 is measured at each side from the obscure panel 30 to the uppermost sheet 96 of stack 76.

Referring now to FIG. 6, indicia 100 may be used to indicate how the towel substrate is to be utilized. For example, a towel substrate that is used to dry hands may be referred to as "hand towels." Indicia help to differentiate the towel substrate from other similarly packaged sheets such as facial tissue. Because dispenser 10 may be oriented more than one way, it is desirable to have the indicia be properly oriented regardless of dispenser orientation. For example, indicia 100 may be read in at least two different directions, such as when dispenser 10 is sitting on a countertop or inverted and used between a wall and a towel bar, as described herein. The indicia shown on FIG. 6 may be applied to any of the other embodiments shown herein.

Special inks or other coatings may be used on the outwardly facing surfaces of carton 12. These inks or her coatings may serve a functional and/or an aesthetic purpose. In one embodiment, an expandable ink is applied to one or more outwardly facing surfaces of carton 12. Expandable ink expands in three dimensions when heated, thereby forming a raised body with respect to the surface on which it is applied. One non-limiting example of an expandable ink is AQUARUFF, obtained from Polytex Environmental Inks ltd., Bronx, N.Y. When the expandable ink is applied to an outwardly facing surface of carton 12, it may have a thickness from about 1 mm to about 3 mm from the surface. Indicia 100 may be made using expandable ink. Further, it is contemplated that an aesthetic design may be applied to more than one outwardly facing surface using the expandable ink. In particular, expandable ink may be applied to any of the outwardly facing surfaces so that when dispenser 10 is in use, the expandable ink protects a surface such as the wall, or protects carton 12 from water damage. Raising carton 12 off of a countertop surface by 1 mm to about 3 mm may prevent water from making contact and soaking into a panel of carton 12, such as the obscure panel or contact panel 22. It is contemplated that several dots of expandable ink may be placed on obscure panel 30 or contact panel 22 to function as feet.

The carton 12 as seen in FIGS. 6, 11, and 13 include a slitted baffle 40 located underneath surfboard 41, as previously described.

In operation, the embodiments of dispenser 10 as shown in FIGS. 1 and 6 may be placed on a horizontal surface such as a table or countertop as seen in FIGS. 2 and 6. However, one may optionally wedge either embodiment of the dispenser 10 between a towel bar 42 and a wall 44 as seen in FIG. 1. Specifically, the contact panel 22 may contact the wall 44, and the dispensing panel 28 may be oriented toward the floor underneath the towel bar 42, while maintaining contact with towel bar 42. The face panel 20 and the contact panel 22 are spaced far enough apart so that when a sheet 16 is pulled in a substantially downward/outward direction 48/49, the dispenser 10 will not slide down between the towel bar and the wall such that the face panel 20 makes contact with the towel bar 42. The stack of sheets to be dispensed from the dispenser 10 may be blocked as described above prior to being dispensed.

When introducing elements of the invention or the preferred aspect(s) thereof, the articles "a", "an", "the" and "said" are intended to mean that there are one or more of the elements. The terms "comprising," "including," and "having" are intended to be inclusive and mean that there may be additional elements other than the listed elements.

The invention claimed is:

1. A sheet dispenser comprising:

a carton comprising six outwardly-facing surfaces; the six outwardly-facing surfaces comprising a face panel substantially parallel to and spaced apart from a contact panel, a first trapezoidal shaped side-panel substantially parallel to and spaced apart from a second trapezoidal shaped side-panel, and a dispensing panel spaced apart from an obscure panel, wherein the dispensing panel and the contact panel form a first edge having an internal angle from about 40° to about 60° , and the dispensing panel and the face panel form a second edge; wherein the dispensing panel comprises a first longitudinal axis and has an opening for dispensing a paper towel, and wherein the opening defines a shape having a second longitudinal axis; and wherein the second longitudinal axis is located between the first longitudinal axis and the first edge; and a stack of individual multi-folded paper towels having a front side having a first height and an opposite rear side having a second height, wherein the first height is less than a second height by 10 mm to 30 mm and the individual multi-folded paper towels having an overlap portion with a depth of 2.75 inches to 3.25 inches.

2. The sheet dispenser of claim 1 further comprising a hanger member extending from one of the six outwardly facing surfaces and selectively attachable to the sheet dispenser.

3. The sheet dispenser of claim 1 wherein an angle formed at the first edge between the dispensing panel and the contact panel is 45°.

4. The sheet dispenser of claim 1 wherein the stack comprises a leading edge that is oriented so that it lies within the opening.

5. A method of dispensing sheets comprising the steps of:

providing a sheet dispenser of claim 1;

identifying a wall having a towel bar mounted thereon at a distance from a floor;

facing the contact panel toward the wall and sliding the sheet dispenser between the towel bar and the wall such that the dispensing panel is oriented toward the floor.

6. The method of claim 5 further including the step of providing a blocked stack of the sheets.

7. A sheet dispenser comprising:

a carton comprising six outwardly-facing surfaces; the six outwardly-facing surfaces comprising a face panel substantially parallel to and spaced apart from a contact panel, a first trapezoidal shaped side-panel substantially parallel to and spaced apart from a second trapezoidal shaped side-panel, and a dispensing panel spaced apart from an obscure panel, wherein the dispensing panel and the contact panel form a first edge having an internal angle from about 40° to about 60° , and the dispensing panel and the face panel form a second edge; wherein the dispensing panel comprises a first longitudinal axis and has an opening for dispensing a paper towel, and wherein the opening defines a shape having a second longitudinal axis; and wherein the second longitudinal axis is located between the first longitudinal axis and the acute edge; and a stack of individual inter-folded paper towels having a front side having a first height and an opposite rear side having a second height, wherein the first height is less than a second height by 10 mm to 30 mm and disposed within the carton, the individual inter-folded paper towels having an overlap portion with a depth of 4.75 inches to 5.25 inches.

8. The sheet dispenser of claim 7 further comprising a hanger member extending from one of the six outwardly facing surfaces and selectively attachable to the sheet dispenser.

9. The sheet dispenser of claim 7 wherein the internal angle of the first edge is 45° .

10. The sheet dispenser of claim 7 wherein the stack of paper towels comprises a leading edge that is oriented so that it lies within the opening.

* * * * *